US010337258B2

(12) United States Patent
Dowdy et al.

(10) Patent No.: US 10,337,258 B2
(45) Date of Patent: Jul. 2, 2019

(54) DUAL OPERATIONAL RIG

(71) Applicant: Rowan Companies, Inc., Houston, TX (US)

(72) Inventors: Michael James Dowdy, Hockley, TX (US); Frankie Derek Necaise, Klin, MS (US)

(73) Assignee: Rowan Companies, Inc., Houston, TX (US)

( * ) Notice: Subject to any disclaimer, the term of this patent is extended or adjusted under 35 U.S.C. 154(b) by 0 days.

(21) Appl. No.: 15/356,987

(22) Filed: Nov. 21, 2016

(65) Prior Publication Data

US 2017/0152713 A1 Jun. 1, 2017

Related U.S. Application Data

(60) Provisional application No. 62/261,610, filed on Dec. 1, 2015.

(51) Int. Cl.

| | |
|---|---|
| ***E21B 17/00*** | (2006.01) |
| ***E21B 15/02*** | (2006.01) |
| ***E21B 15/00*** | (2006.01) |
| ***E02B 17/00*** | (2006.01) |
| ***E21B 7/00*** | (2006.01) |
| *E04B 1/34* | (2006.01) |

(52) U.S. Cl.

CPC ..... *E21B 15/003* (2013.01); *E02B 17/00* (2013.01); *E21B 7/00* (2013.01); *E21B 15/02* (2013.01); *E02B 2017/0056* (2013.01)

(58) Field of Classification Search

None

See application file for complete search history.

(56) References Cited

U.S. PATENT DOCUMENTS

| | | | | |
|---|---|---|---|---|
| 4,819,730 | A | 4/1989 | Williford et al. | |
| 6,047,781 | A | 4/2000 | Scott et al. | |
| 6,491,477 | B2 * | 12/2002 | Bennett, Jr. | E21B 15/003 114/265 |
| 6,729,804 | B1 * | 5/2004 | Roodenburg | B63B 35/44 175/5 |
| 6,926,097 | B1 | 8/2005 | Blake | |
| 7,083,004 | B2 * | 8/2006 | Roodenburg | E02B 17/021 166/366 |

(Continued)

FOREIGN PATENT DOCUMENTS

| | | | |
|---|---|---|---|
| EP | 2208853 | A2 | 7/2010 |
| WO | 2012/053982 | A1 | 4/2012 |
| WO | 2014/186889 | A1 | 11/2014 |

OTHER PUBLICATIONS

Int'l Search Report and Written Opinion in counterpart PCT Appl. PCT/US2016/063038, dated Jan. 30, 2017, 10-pgs.

(Continued)

*Primary Examiner* — Matthew R Buck
*Assistant Examiner* — Douglas S Wood
(74) *Attorney, Agent, or Firm* — Blank Rome LLP

(57) ABSTRACT

A dual tower rig includes a hull supported by one or more legs and includes a cantilever assembly coupled to the hull. Dual towers are supported by a skidding system that is coupled to the cantilever assembly. The towers are configured to conduct independent operations and are movable relative to each other and to the hull by the skidding system and the cantilever assembly.

38 Claims, 10 Drawing Sheets

(56) References Cited

U.S. PATENT DOCUMENTS

| | | | | |
|---|---|---|---|---|
| 8,911,179 | B2 | 12/2014 | Noble et al. | |
| 9,284,706 | B2 * | 3/2016 | Roodenburg | B66C 5/10 |
| 9,366,091 | B2 | 6/2016 | Garder | |
| 2002/0159840 | A1 | 10/2002 | Bennett et al. | |
| 2004/0151549 | A1 | 8/2004 | Roodenburg et al. | |
| 2008/0131209 | A1 | 6/2008 | Thomas | |
| 2010/0147524 | A1 | 6/2010 | Springett et al. | |
| 2010/0221069 | A1 | 9/2010 | Brinkmann et al. | |
| 2011/0158784 | A1 * | 6/2011 | Altman | B63B 27/02 414/803 |
| 2012/0067642 | A1 | 3/2012 | Magnuson | |
| 2012/0321393 | A1 | 12/2012 | Wilinson, Jr. | |
| 2015/0034383 | A1 * | 2/2015 | Roodenburg | B66C 5/10 175/5 |
| 2015/0330048 | A1 | 11/2015 | Garder | |

OTHER PUBLICATIONS

First Office Action in counterpart Canadian Appl. 3006734, dated Apr. 8, 2019, 6-pgs.

* cited by examiner

DUAL OPERATIONAL RIG

CROSS-REFERENCE TO RELATED APPLICATIONS

This is non-provisional of U.S. Patent Appl. Ser. No. 62/261,610, filed 1 Dec. 2015 and entitled "Dual Tower Decommissioning Rig," which is incorporated herein by reference in its entirety and to which priority is claimed.

BACKGROUND OF THE DISCLOSURE

1. Field of the Disclosure

The subject matter of the present disclosure generally relates to a multiple tower rig for decommissioning (e.g., plug and abandon), drilling, and other offshore operations.

2. Description of the Related Art

For many years, drilling rigs have provided the ability to drill wells into the seabed and access hydrocarbon reservoirs located thousands of feet below the seafloor. After the hydrocarbon reserves have been depleted, however, it is frequently challenging and expensive to decommission (e.g., plug and abandon) these subsea wells. Drilling rigs are typically leased on a daily basis and equipped for conducting drilling operations, making them very expensive to use for decommissioning operations, which often do not require the use of all of the equipment located on a drilling rig. In addition, most drilling rigs include only one drilling tower, which limits the operation to one well at a time.

Therefore, there is a need for a rig system for efficiently decommissioning wells and performing other offshore operations.

SUMMARY

According to the present disclosure, an offshore rig for operating at separate wells includes a hull, a cantilever assembly, and at least two operational assemblies. The hull is positionable relative to the separate wells, and the cantilever assembly movably mounted relative to the hull. The at least two operational assemblies are each movably mounted independent of each other relative to the cantilever assembly and to the hull. The at least two operational assemblies are operable to conduct separate operations of the separate wells independent of one another in both time and space. The separate operation being conducting can be decommissioning the separate well, plug and abandoning the separate well, working over the separate well, drilling the separate well, completing the separate well, and logging the separate well.

The cantilever assembly can have a base mounted on one or more beams of the hull, and the base can be moveable along at least one direction on the one or more beams relative to the hull. The at least two operational assemblies can each have a platform supported on the cantilever assembly and moveable along at least one direction relative to the hull.

For example, each of the platforms can be mounted on one or more rails of the cantilever assembly, and the platforms can be moveable along the at least one direction on the one or more rails relative to the cantilever assembly. Additionally, each of the platforms can be mounted on one or more pads disposed on the one or more rails of the cantilever assembly. Each platform can be moveable along another of the at least one direction on the one or more pads relative to the cantilever assembly. Overall, the cantilever assembly can be moveable at least along a first direction relative to the hull, and the at least two operational assemblies can each be independently moveable in the first direction and a second direction orthogonal to the first direction.

The at least two operational assemblies can each have separate equipment dedicated to the operational assembly for conducting the separate operation. For example, the separate equipment can include fluid handling equipment, mud return equipment, well control equipment, solid handling equipment, pipe handling equipment, power generation equipment, and degasser equipment. Moreover, the at least two operational assemblies can have equipment shared between the operational assemblies for conducting the separate operations. For example, the shared equipment can be BOP handling equipment, swarf skip equipment, a knuckle boom crane, and fluid handling equipment.

Each of the at least two operational assemblies includes a well center so that the well centers define a work zone positionable relative to the separate wells. The hull is positionable in a plurality of headings to position the defined work zone relative to the separate wells.

The cantilever assembly can include a handling area between the at least two operational assemblies. The handling area can have a plurality of rails movable in one direction on the cantilever assembly and comprising a plurality of carts movable on the rails in an orthogonal direction. The handling area can define a moonpool positionable relative to the separate wells. The rails can include a first set of the rails movable in the one direction relative to the moonpool and can include a second set of the rails movable in the one direction relative to the first set of the rails. The first and second sets of rails can therefore be alignable and misalignable with one another.

Each of the operational assemblies can have a swarf unit with a pipe rotatably coupled thereto and communicating with the handling area between the at least two assemblies. Further, each of the operational assemblies can have a fluid return component being telescopic in a first direction with movement of the each operational assembly in the first direction relative to the cantilever assembly. The cantilever assembly can have a trough in fluid communication with the fluid return component that allows for translation of the first fluid return component in a second orthogonal direction with movement of the each operational assembly in the second direction relative to the cantilever assembly. The cantilever assembly can have separate fluid return equipment in fluid communication with each of the troughs for the at least two operational assemblies.

In one embodiment, an offshore rig is used for decommissioning of separate wells. The rig includes a hull, a cantilever assembly, and at least two decommissioning assemblies. The hull is positionable relative to the separate wells, and the cantilever assembly is movably mounted relative to the hull. The at least two decommissioning assemblies are each movably mounted independent relative to each other and relative to the cantilever assembly. The at least two decommissioning assemblies are configurable to conduct independent and simultaneous decommissioning operations of the separate wells.

According to the present disclosure, an offshore rig is used for operating at separate wells. The rig includes a hull and at least two operational assemblies. The hull is positionable relative to the separate wells, and the at least two operational assemblies are each movably mounted independent of each other relative to the hull. The at least two operational assemblies are operable to conduct separate operations of the separate wells independent of one another in both time and space.

According to the present disclosure, a method of performing operations on separate wells with an offshore rig involves positioning a hull of the offshore rig relative to the separate wells; moving a cantilever assembly mounted relative to the hull toward the separate wells; configuring at least two operational assemblies by moving each mounted independent of one another relative to the cantilever assembly and relative to the hull toward the separate wells; and conducting separate operations on the separate wells in both time and space with the at least two operational assemblies.

The foregoing summary is not intended to summarize each potential embodiment or every aspect of the present disclosure.

DETAILED DESCRIPTION

Figure 1:
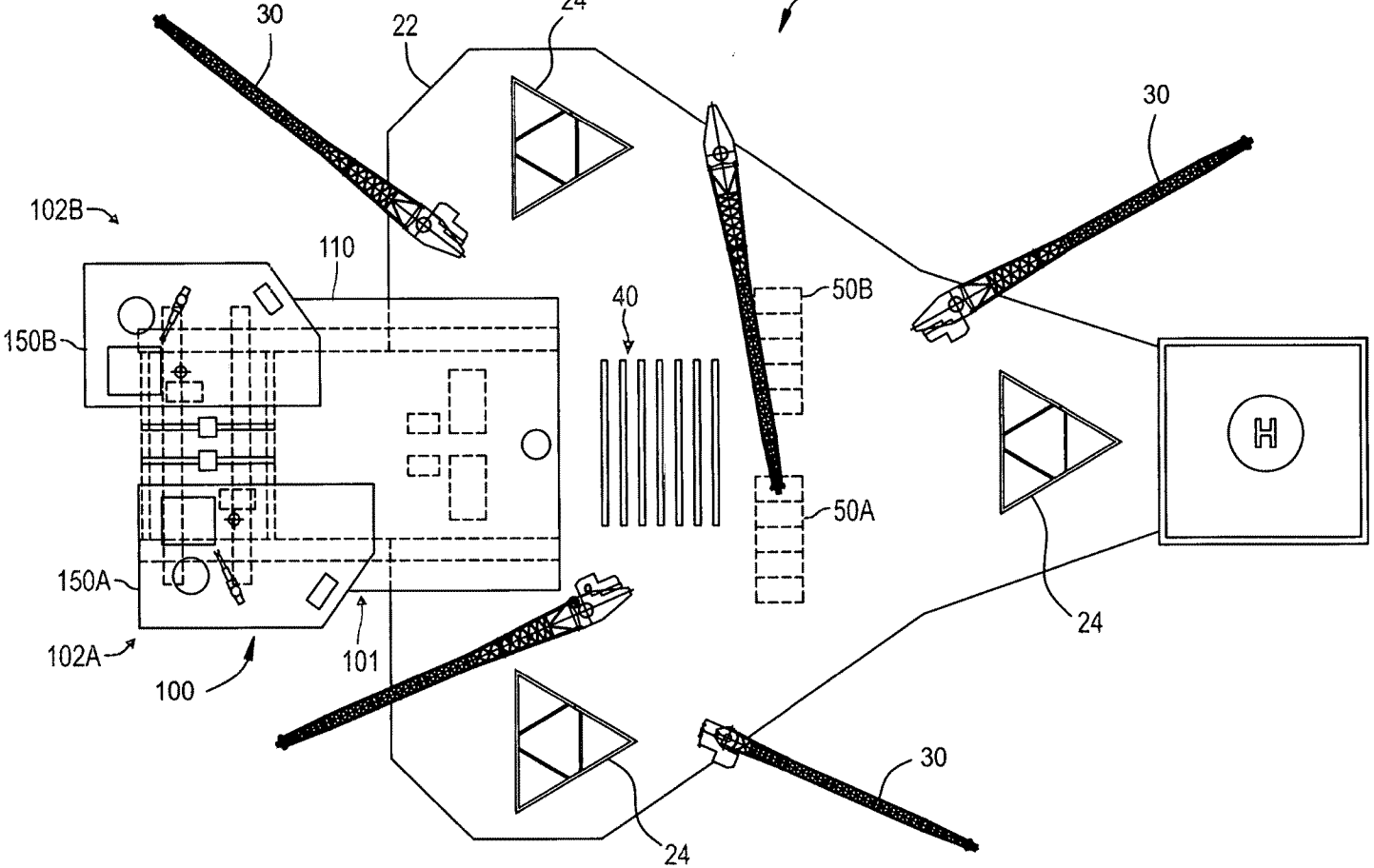
FIG. 1 illustrates a schematic plan view of a multiple operational rig according to the present disclosure.

FIG. 1 illustrates a schematic plan view of a multiple operation rig 20 for performing multiple operations according to one embodiment of the present disclosure. The rig 20 includes a hull 22 supported by a plurality of extendable and retractable legs 24 and equipped with a plurality of cranes 30 to assist with moving and supporting equipment to conduct various rig operations. The rig 20 may also be equipped with various facilities, including living quarters and control rooms, as well as any auxiliary equipment necessary to operate the rig 20 offshore. Although shown here as a jack-up rig, the rig 20 may be configured as a floating, fixed, or semi-submersible rig or vessel according to other embodiments.

According to the present embodiment, the multiple operation rig 20 includes a dual tower system 100 as described in more detail with respect to FIG. 2 below. Using the dual tower system 100, the rig 20 is equipped to conduct two completely independent operations, such as decommissioning (e.g., plug and abandonment), workover, drilling, completions, logging, and other offshore operations. The operations may be conducted simultaneously or at different times and can be conducted on different wells. The rig 20 is configured such that these separate operations can share one or more of the same resources if necessary, as further described below.

As disclosed herein, the rig 20 can be used for plug and abandon in decommissioning operations of wells, but the rig 20 can also be used for working over, drilling, and performing other offshore operations on at least two wells independently in both time and space. Moreover, due to the independent operability of the disclosed rig 20, operations such as workover, plug and abandon, and the like can be performed with at least one of the towers on the rig 20 while the other tower performs drilling or some different operation.

Figure 2:
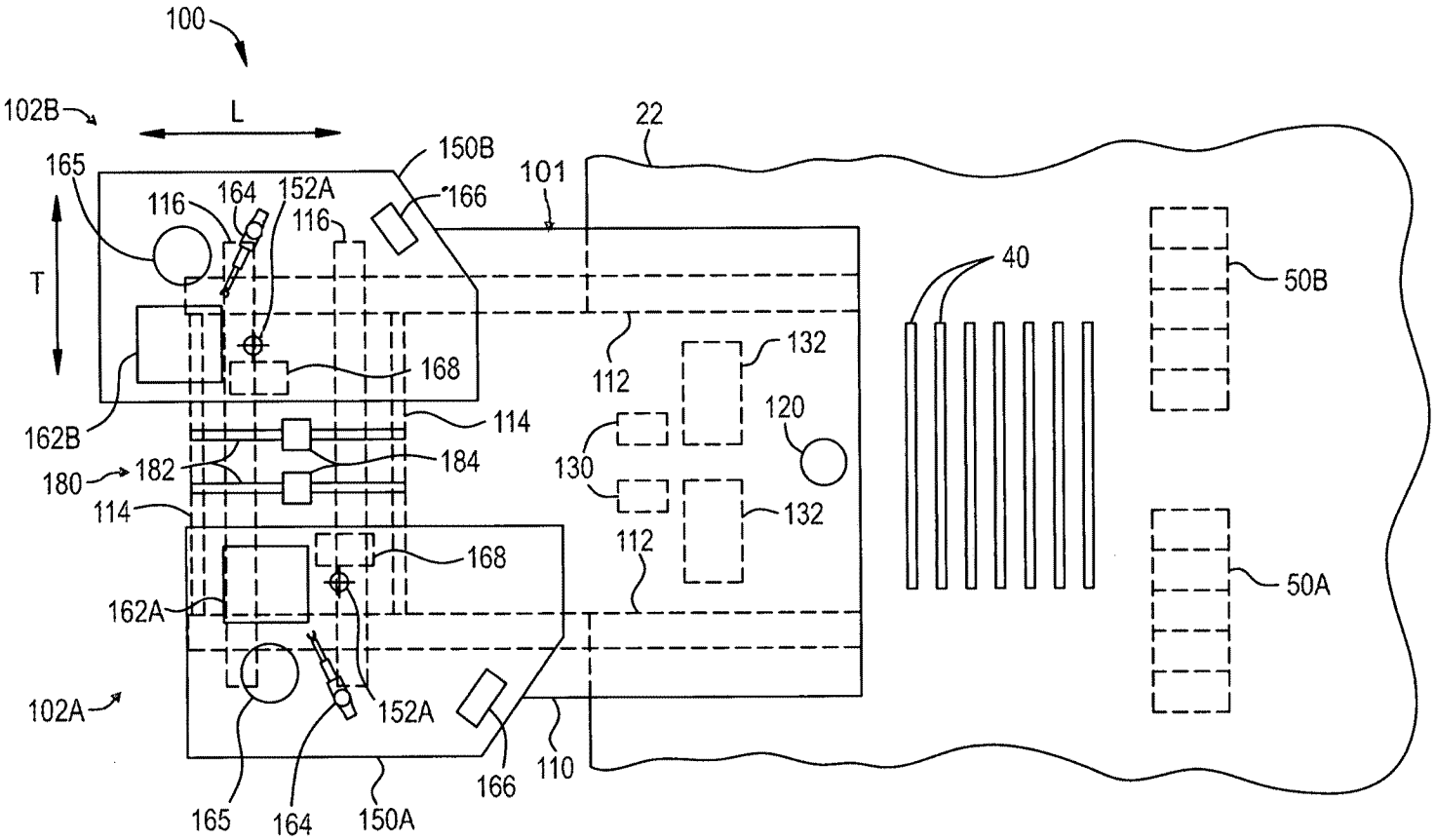
FIG. 2 illustrates an enlarged view of a portion of the disclosed rig.

FIG. 2 illustrates an enlarged view of the dual tower system 100 of the rig 20 according to the present disclosure. The system 100 includes at least two operational assemblies 102A-B having first and second towers 162A-B that are supported on first and second drill floor platforms 150A-B. The platforms 150A-B are in turn supported by a skidding system that includes skidding rails 116 and skidding pads 190 (shown in FIG. 3), which are coupled to a base 110 of a cantilever assembly 101. The base 110 of the cantilever assembly 101 is coupled to and movable relative to the vessel's hull 22 by one or more cantilever beams 112 and a skidding system.

The dual platforms 150A-B that support the towers 162A-B can be moved relative to the vessel's hull 22 in both forward and aft directions (indicated by reference arrow L) by the base 110 of the cantilever assembly 101. In addition, the dual platforms 150A-B that support the towers 162A-B can be further moved independently, relative to each other and relative to the hull 22 in both forward and aft directions (indicated by reference arrow L), as well as in a lateral direction (indicated by reference arrow T) along the skidding rails 116 using the skidding pads 190 (shown in FIG. 3).

Each of the at least two operational assemblies 102A-B can include separate equipment dedicated to the operational assembly 102A-B for conducting the separate operation. The separate equipment can include fluid handling equipment, mud return equipment, well control equipment, solid handling equipment, pipe handling equipment, power generation equipment, and degasser equipment.

For example, each assembly 102A-B includes the platform 150A-B with the tower 162A-B. Each tower 162A-B may include drawworks, top drives, manipulator arms, and any other equipment necessary (not necessarily shown) to conduct operations through separate well centers 152A-B of the platforms 150A-B. As shown, each tower 162A-B may be independently supported by a manipulator arm 164, a pipe carousel 165, a driller's cabin 166, a degasser system (not shown), a swarf handling system 168, and a shaker system 132, which are disposed on each respective platform 150A-B or within the base 110 of the cantilever assembly 101 as appropriate.

The at least two operational assemblies 102A-B can also include equipment shared between the operational assemblies 102A-B for conducting the separate operations. The shared equipment can include BOP handling equipment, swarf skip equipment, a knuckle boom crane, and fluid handling equipment. For example, a knuckle boom crane 120 may be provided for handling pipes from a plurality of pipe racks 40 located on the hull 22 to and from each platform 150A-B.

Additionally, a handling area 180 may be included with the system 100. The handling area 180 may include two blow out preventer (BOP) handling systems located in a moonpool of the base 110 of the cantilever assembly 101 and positioned below and between the respective platforms 150A-B. The BOP handling systems may include trolleys 184 that are movable in the forward and aft directions along rails 182, which may move in the lateral direction over the moonpool along rails 114 or the like. As described in more detail below, the BOP handling systems can be used for independent handling of BOPs, swarf units, and other components for each platform 150A-B. In general, independent BOP control systems are provided for each platform 150A-B, although they may utilize the same hydraulic power unit and accumulator sources.

Each tower 162A-B may be independently powered by a power/control system 50A-B. Each power/control system 50A-B may include, but is not limited to, hydraulic, electric, and/or pneumatic lines, pumps, programmable logic controllers, power units, valving, manifolds, and/or other equipment necessary to power, control, manage, and/or monitor the operations conducted by each tower 162A-B. Components of the systems 50A-B can be positioned on the hull 22, on the cantilever base 110, and/or on the drill floor platforms 150A-B, as the case may be. The resources of each power/control system 50A-B can be used to support either tower 162A-B if necessary. Finally, any other additional equipment as known in the art can be used to support each tower 162A-B to conduct the necessary operations.

Figure 3:
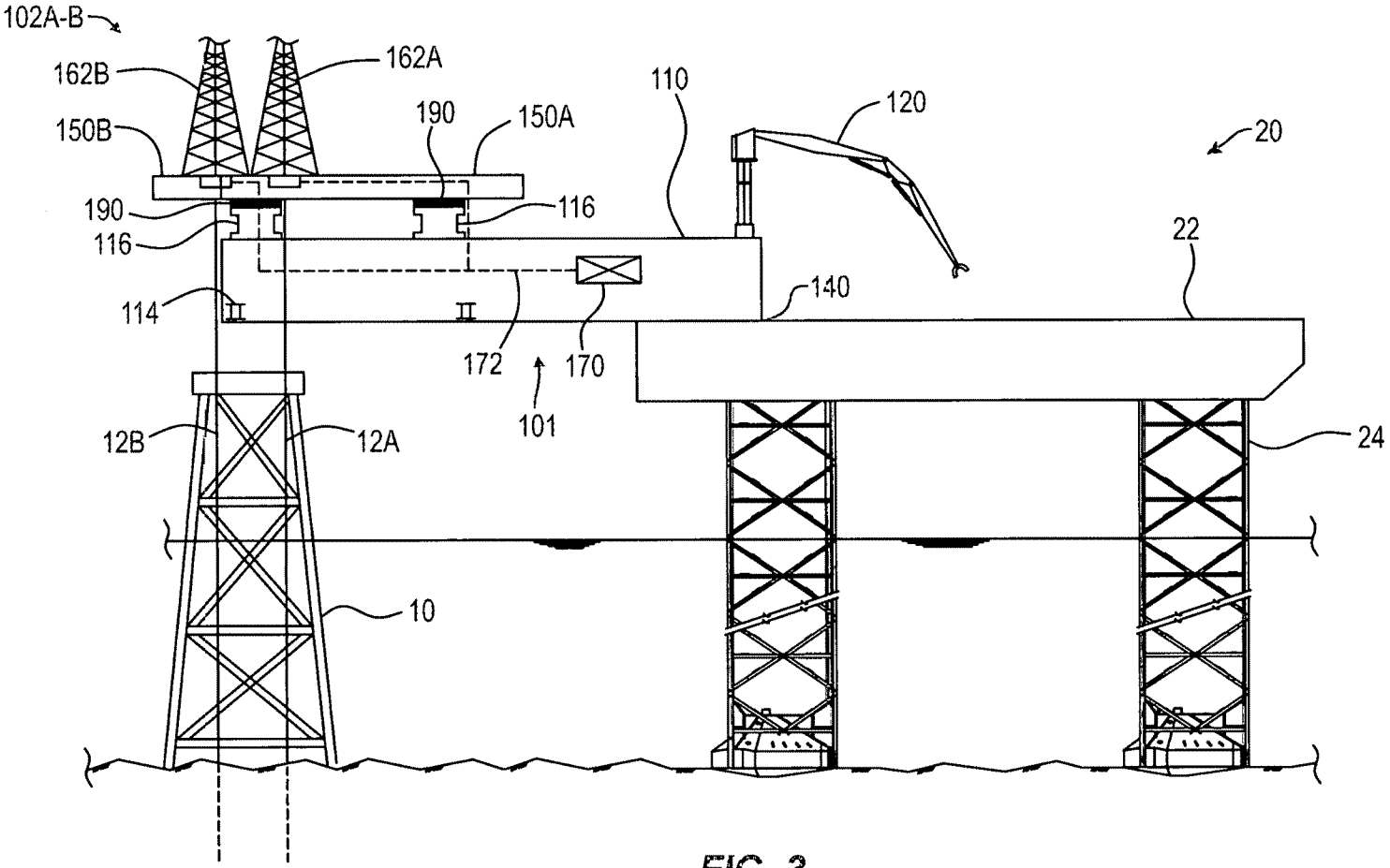
FIG. 3 illustrates a side view of the disclosed rig.

FIG. 3 illustrates a side view of the dual operation rig 20 positioned relative to an existing offshore rig or subsea template 10. (As will be appreciated, components are not necessarily depicted in scale.) As depicted here, the dual towers 162A-B can support two separate work strings 12A-B to conduct independent operations on two separate wells supported by the offshore platform 10, simultaneously or at different times. The particular operations can involve decommissioning as one example. In general, however, the work strings 12A-B may include a jointed tubular string, a coiled tubing string, or a wireline that is supported by the towers 162A-B to decommission, plug and abandon, drill, or perform other operations on the wells.

As shown, the second tower 162B (which is supported by the second platform 150B located behind the first platform 150A) can be positioned at a different distance from the hull 22 than the first tower 162A using the skidding system incorporated into the platforms 150A-B. In general, the skidding system is schematically illustrated as having one or more skidding rails 116 and one or more skidding pads 190 disposed on the skidding rails 116 that are configured to allow the platforms 150A-B to move in both the forward and aft directions as well as in the lateral direction relative to the hull 22. Various skidding systems are known in the art and can be used.

Also shown, one or more fluid lines 172 extend from the towers 162A-B and communicate with a fluid handling system 170 to control the supply, separation, and/or return of fluids, such as mud, to and from the towers 162A-B during operations. The fluid handling system 170 may include a plurality of pits for containing the fluids, as well as pumps, valving, manifolds, and/or other equipment necessary to conduct the operations. The second tower 162B may similarly include separate fluid lines and fluid handling system. However, the fluid handling system 170 of each of the dual towers 162A-B can be shared between the towers 162A-B if necessary. For example, the fluid handling system 170 may include multiple mud pumps, such as four mud pumps, so each tower 162A-B can use two mud pumps (one of which offers redundancy). The mud pit capacity and storage equipment for the fluid handling system 170 can be readily split into two independent systems. Various components of the fluid handling system 170, including, for example, the shakers, sand traps, swarf handling units, and the like, may be located at the base 110 of the cantilever assembly 101 to improve fluid handling in the dual rig skidding arrangement.

Having independent towers 162A-B on the single rig 20 provides the advantage of conducting operations efficiently and faster. In decommissioning operations, for example, the time required to plug and abandon multiple platform wells at a single offshore location can be cut in half or even less with the independent towers 162A-B when compared to a rig with a single tower. Because the towers 162A-B are functionally independent, they can move at different times to different wells during the decommissioning process, and the activity performed on one tower 162A-B does not impede or limit the activity performed on the other 162A-B. Operations may continue completely independently of each other. This is a distinct advantage for servicing offshore platforms that normally support a plurality of wells. In addition, if necessary, decommissioning resources dedicated to one tower 162A or 162B can be used to support the decommissioning operations of the other tower 162A or 162B. Although discussed in context of decommissioning, the above advantages can apply equally well to other types of operations.

Figure 4:
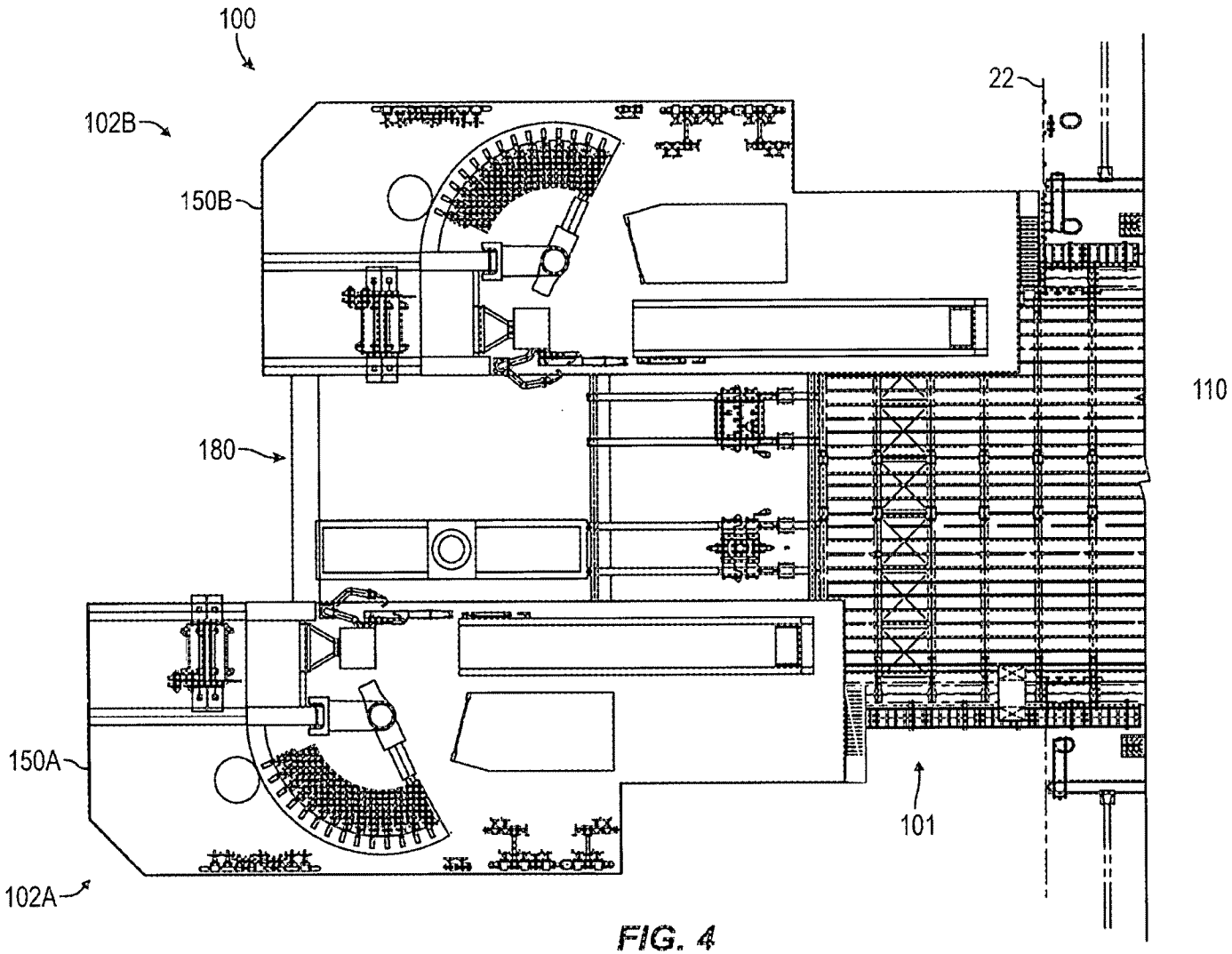
FIG. 4 illustrates a plan view of a cantilever assembly with dual drill floor platforms for the disclosed rig in additional detail.

FIG. 4 illustrates a plan view of the dual platforms 150A-B for the disclosed rig (20) in additional detail. As shown, the system 100 can extend the dual platforms 150A-B of the two operational assemblies 102A-B from the side of the rig's hull 22 on the base 110 of the cantilever assembly 101, which uses the skidding system affixed to cantilever beams on the main deck of the rig 20 for longitudinal skidding. As noted above, each of the drill floor platforms 150A-B can move longitudinally and laterally with skidding systems on beams as well.

A handing area 180 with a moonpool is disposed in a lower area below and between the drill floor platforms 150A-B. The handling area 180, which is discussed in more detail below, allows for movement of various pieces of equipment, such as BOPs, swarfing equipment, etc., relative to the drill floor platforms 150A-B.

The platforms 150A-B are arranged symmetrical to one another and have independent components. Additional details are discussed below with reference to FIG. 6. In general, each platform 150A-B has a well center 152A-B for conducting operations with any wells and the like situated under the cantilever base 110.

Figure 5A:
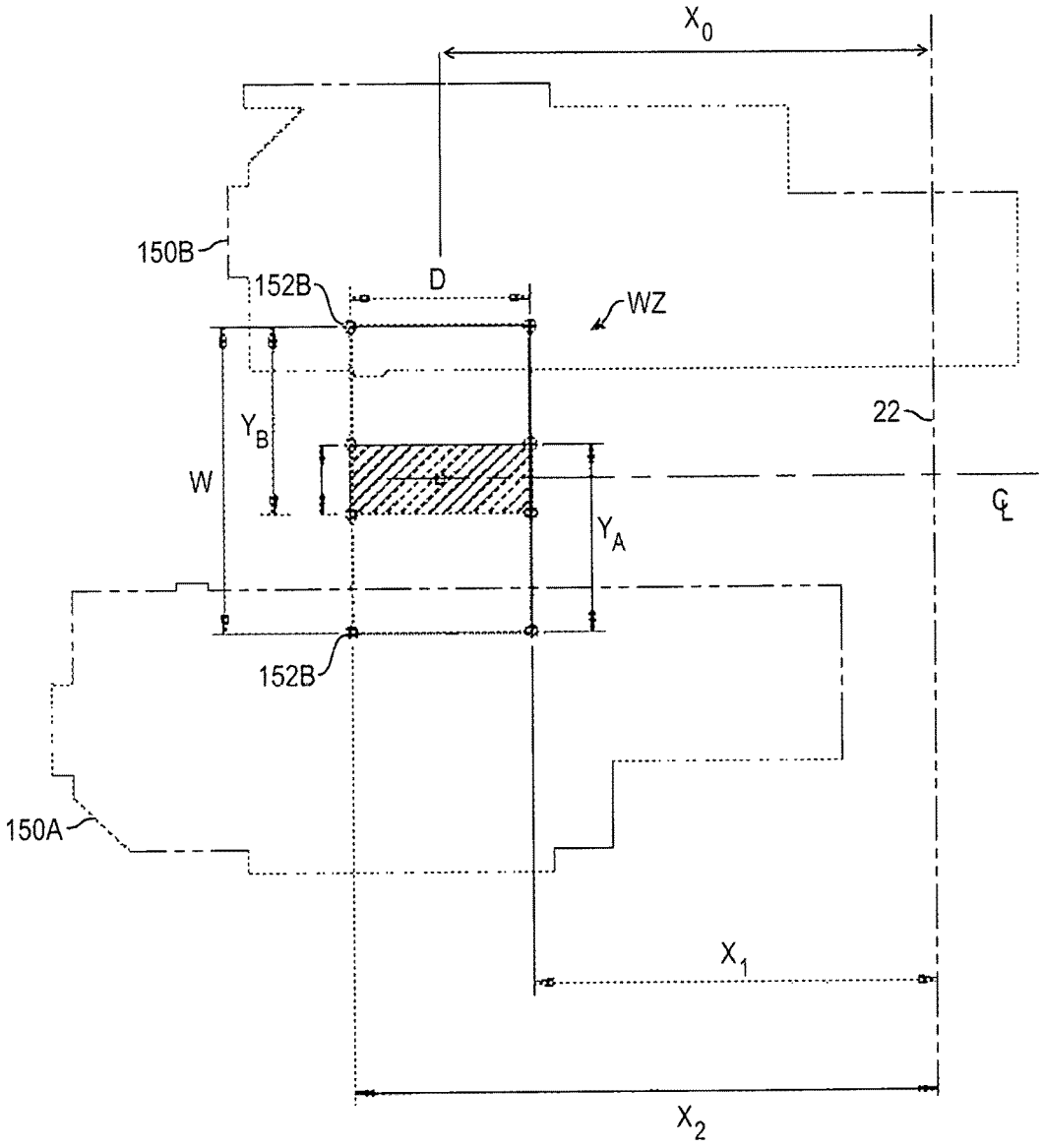
FIG. 5A illustrates a schematic work zone for the dual drill floor platforms of the system in FIG. 4.

Because the two platforms 150A-B can be moved independently in both longitudinal and lateral directions, the two well centers 152A-B define a work zone between them, as schematically shown in FIG. 5A, in which operations can be conducted. In one implementation, the cantilever base 110 can extend a longitudinal distance $X_0$ from the edge of the rig's hull 22. Each platform 150A-B can move a longitudinal distance between $X_1$ and $X_2$ on the cantilever base 110 and can move in a lateral distance $Y_A$, $Y_B$ on the cantilever base 110. This defines a work zone WZ of a depth D and a width W with a shared area (shaded) between the two well centers 152A-B.

In one example arrangement, the longitudinal distance $X_1$ can be 59-ft (or 74-ft with a cantilever extension $X_0$ of 15-ft), and the longitudinal distance $X_2$ can be 85-ft (or 100-ft with a cantilever extension $X_0$ of 15-f). The platforms 150A-B can move forward and aft about 26-ft., which gives the work zone WZ an operable depth D of 26-ft. The platforms 150A-B can each move laterally the distance $Y_A$, $Y_B$ of about 28-ft., which gives the work zone WZ an operable width W of 45-ft. These measurements are merely exemplary and may apply to a rig having a cantilever capacity of about 3,750 kips at 75-ft reach using wide skid rail spacing. Other configurations are possible.

Figure 5B:
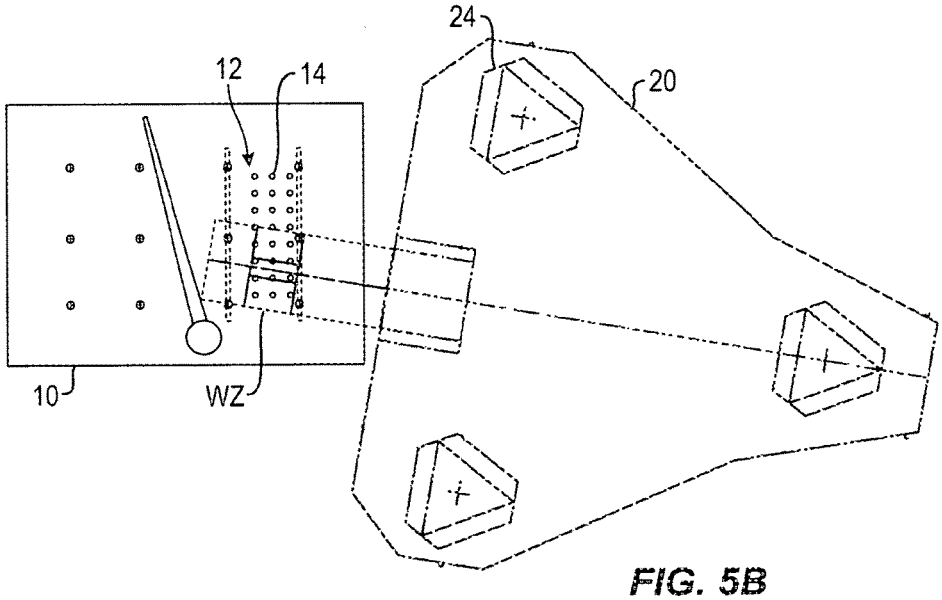
FIGS. 5B-5C illustrate example orientations of the work zone of the disclosed rig to reach multiple wells on a subject offshore platform.
Figure 5C:
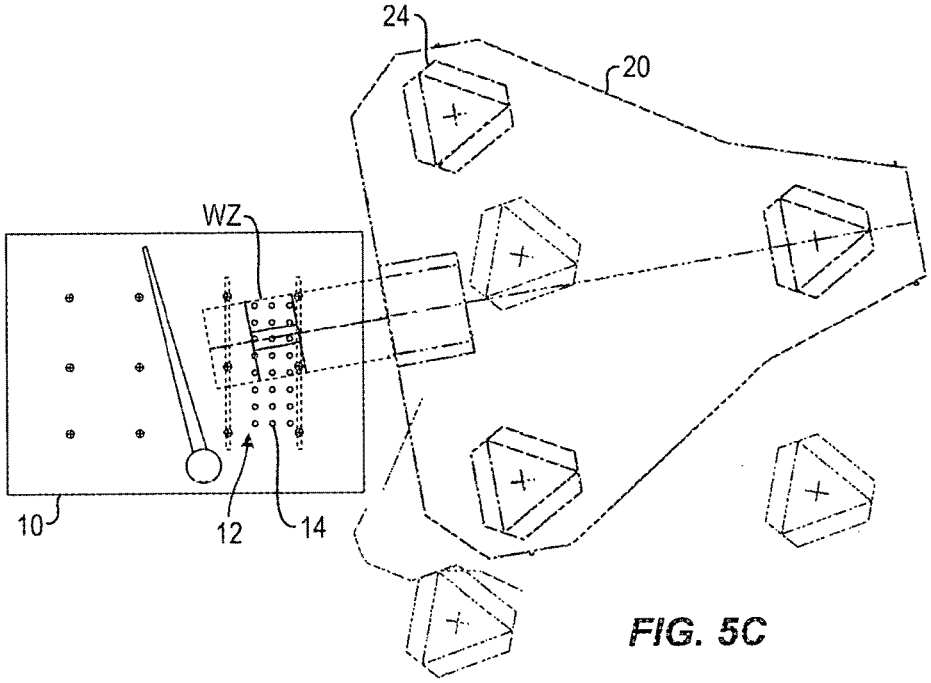

The work zone WZ allows the dual platforms 150A-B to conduct operations over a large area. For example, FIGS. 5B-5C illustrate example orientations of the work zone WZ of the disclosed rig 20 for reaching multiple wells 14 on a subject offshore platform 10. Many offshore platforms may have a variety of wells 14 in one or more well bays 12. Here, the offshore platform 10 has one well bay 12 with wells 14 arranged in multiple rows and columns. Other platforms may have more well bays and different arrangements of wells.

The disclosed rig 20 can be oriented in different headings relative to the subject platform 10 to reach additional well bays 12 and wells 14. For example, FIGS. 5B-5C shows the rig 20 in two headings so that the work zone WZ can reach additional wells 14 in the large well bay 12. Should the platform 10 have any wells on an opposing side, the rig 20 can be situated in other headings as needed around the sides of the platform 10 to reach other wells.

Figure 6A:
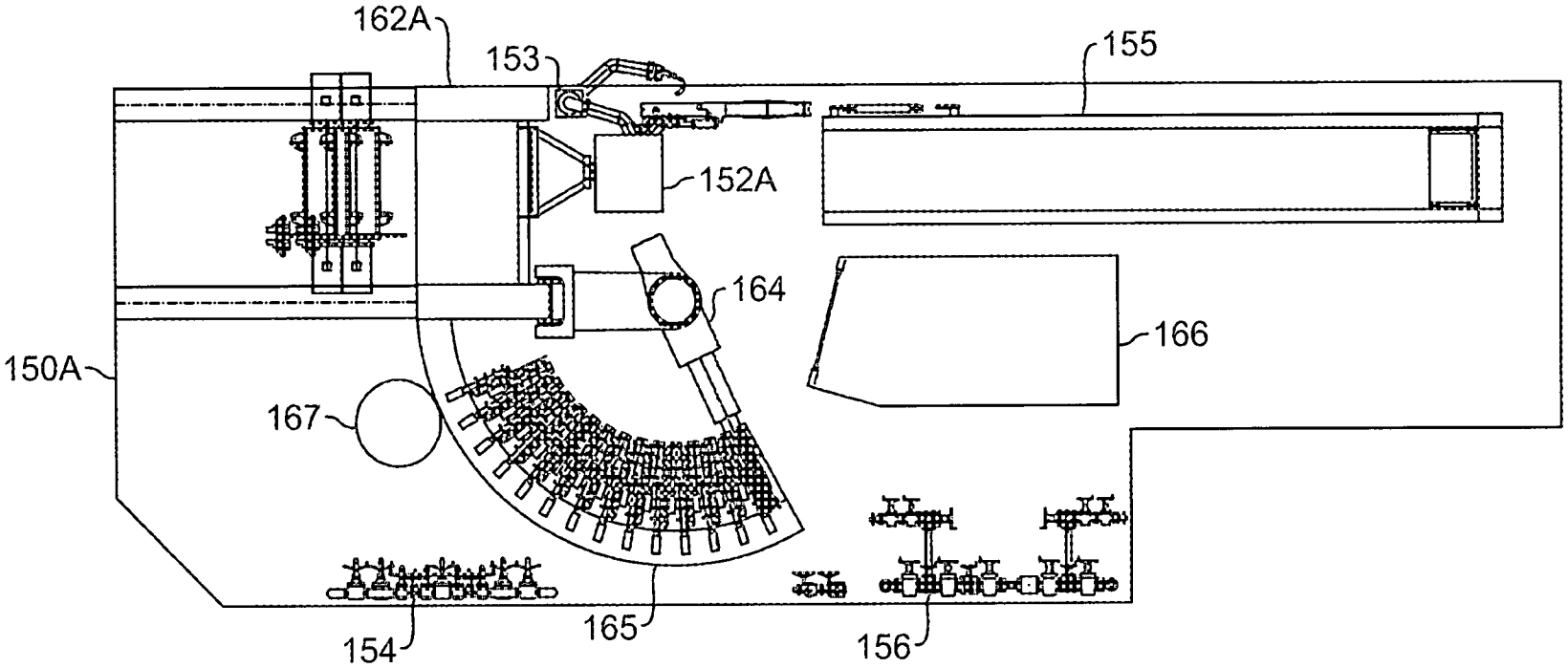
FIG. 6A illustrates a plan view of one of the drill floor platforms for the disclosed rig in isolated detail.

As noted above, the dual drill floor platforms 150A-B are symmetrical. Each 150A-B has an arrangement of components suited for operating relative to the well center 152A-B on the platform 150A-B. For example, FIG. 6A illustrates a plan view of one of the platforms 150A for the disclosed rig (20) in isolated detail. As noted previously, the platform 150A includes the tower 162A, the automated pipe handler 164, the pipe carousel 165, the driller's housing 166, the mud gas separator 167, and other components relative to the well center 152A.

As also shown here, the platform 150A includes a standpipe manifold 154 and a choke and kill manifold 156 dedicated to fluid handling for the well center 152A. A catwalk machine 155 on the platform 150A can handle tubulars relative to the well center 152A. Finally, a rotary table (not shown) and other needed components can be installed at the well center 152A.

Figure 6B:
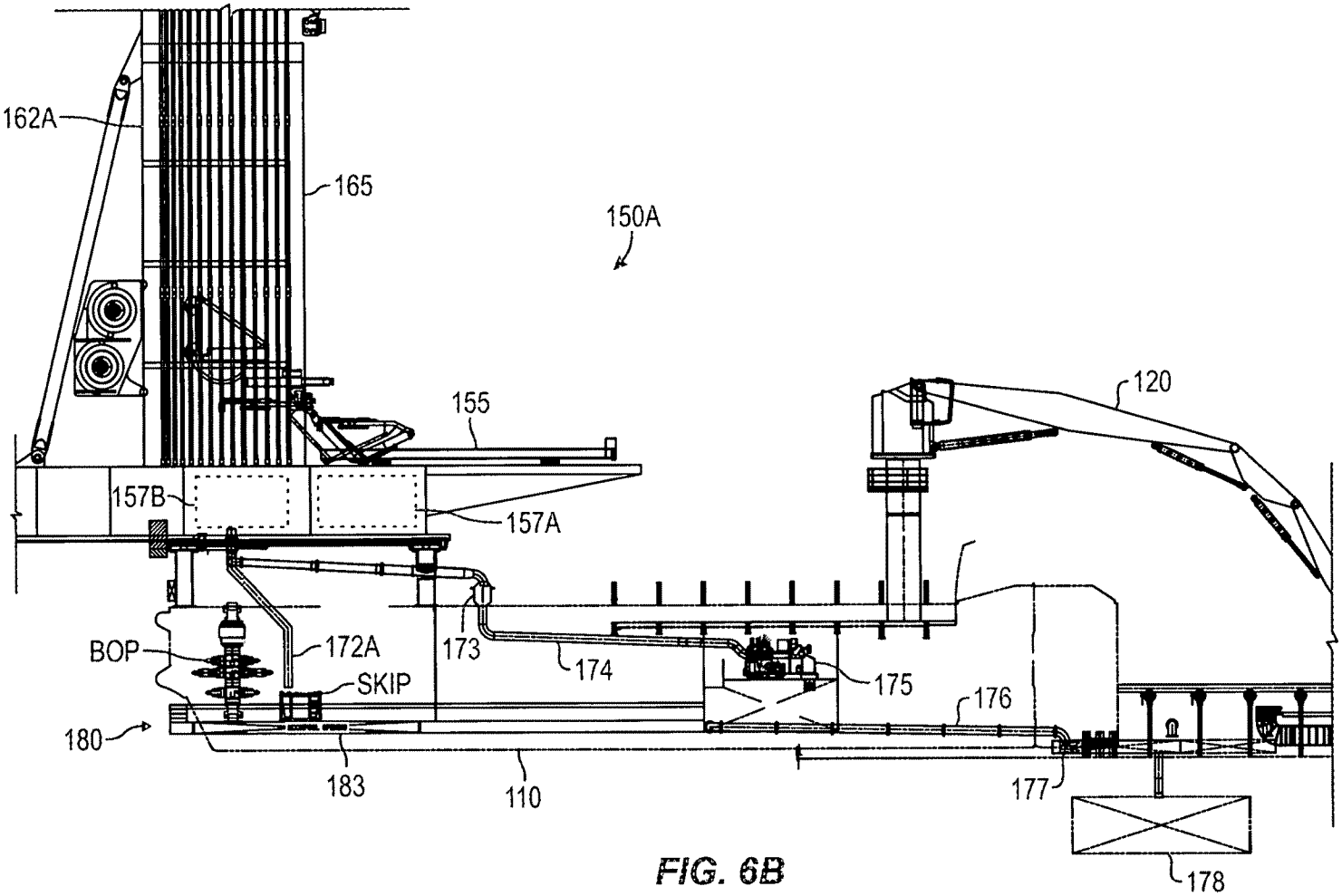
FIG. 6B illustrates a side view of one of the drill floor platforms on the cantilever assembly for the disclosed rig in isolated detail.

FIG. 6B illustrates a side view of the platform 150A for the disclosed rig (20) in isolated detail. The tower 162A includes a suitable top drive (not shown) for the intended operations. The pipe carousel 165 holds various stands of pipe around the fully automated pipe-handling manipulators 164 and near to the catwalk machine 155 and other components at the well center.

Below the drill floor, the platform 150A includes a hydraulic power unit 157A, a swarf unit 157B, components of the fluid handling system (170), and other necessary equipment. The swarf unit 157B may be disposed close to the bell nipple. From the swarf unit 157B, a swarf chute 172A can rotate to accommodate different positions and can communicate with a swarf skip positioned over the moonpool 183 in the handling area 180 on the cantilever base 110. As discussed below, the swarf skip can travel transversely and longitudinally on BOP carts in the moonpool 183.

A sloped mud return line 172B has a swivel joint, and the line 172B can telescope longitudinally and can move transversely with the movement of the platform 150A. The line 172B connects to a mud return trough 173, which connects via mud return pipes 174, 176 to a shaker 175, another trough 177, and mud pits 178. Each platform 150A-B includes its own swarf unit 157B, swarf chute 172A, and return line 172B. The return lines 172B from the two platforms 150A-B can feed into a divided and shared mud trough 173, which connects by separate sets of the return pipes 174, 176 to dedicated shakers 175, mud troughs 177, etc. for each platform 150A-B. (Although not shown, fluid delivery from mud pumps and the like of the system can have similar or different arrangements suited for delivering high pressure fluid.)

Figure 7:
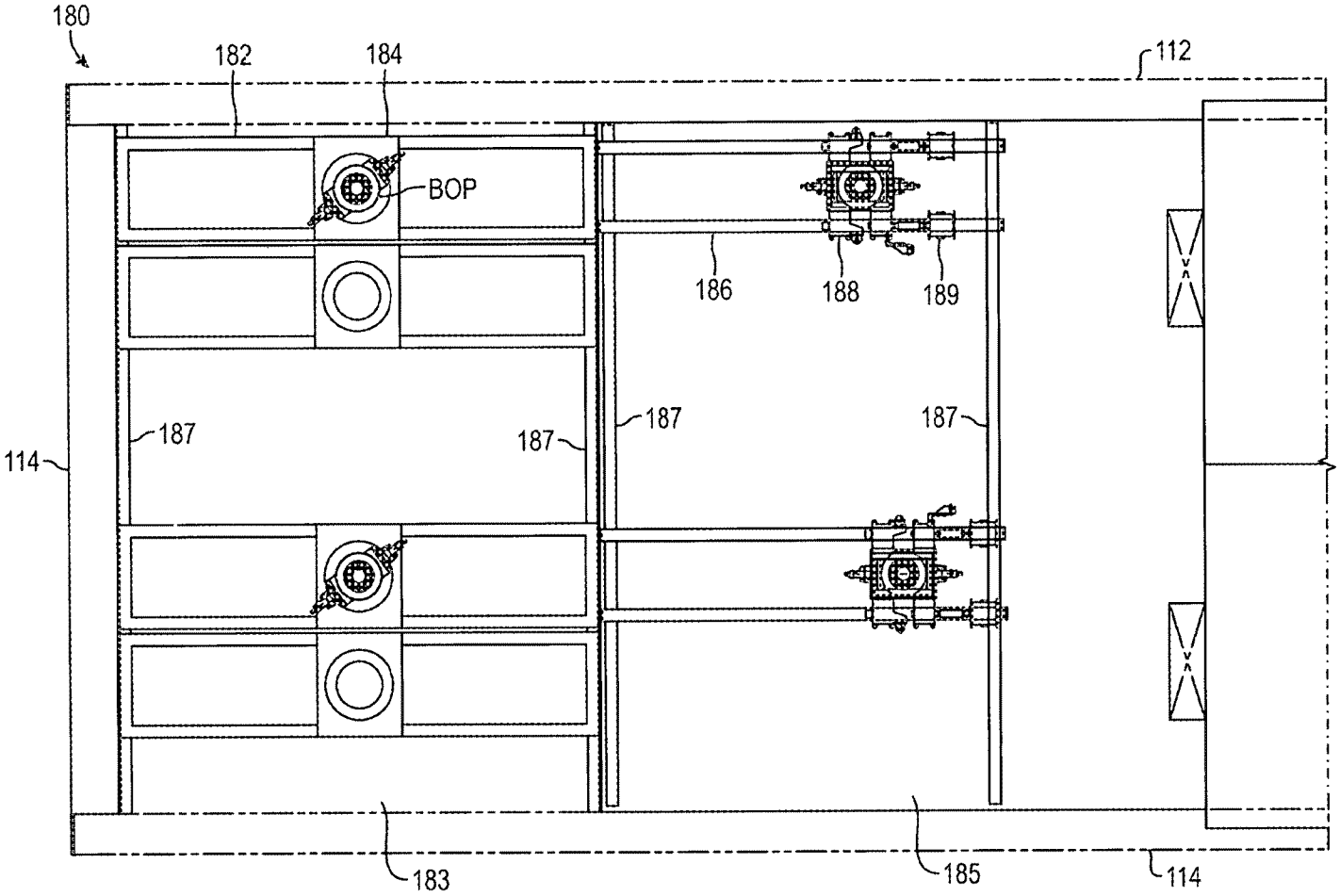
FIG. 7 illustrates a plan view of a handling area between the dual platforms for the disclosed rig.

As noted above, the dual platforms 150A-B share a common handling area 180 underneath and between them for performing various operations. For example, FIG. 7 illustrates a plan view of the handling area 180 on the cantilever base 110 between the platforms (150A-B) for the disclosed rig. The handling area 180 includes a moonpool 183 and an adjacent handling floor 185. The moonpool 183 as noted herein is positioned in the common area under and between the two platforms (150A-B). Lateral rail pairs 182 can move along end rails 187 over the moonpool 183, and carts 184 can move on the rail pairs 184 to move BOPs, swarf units, and other equipment under the well centers (152A-B). The carts 184 can be moved using hydraulic skidding systems (not shown), such as known in the art.

The handling floor 185 can hold various pieces of equipment for placement and arranging on the rail pairs 182 over the moonpool 183. In a similar fashion to the moonpool area, lateral rail pairs 186 move along end rails 187 over the floor 185, and carts 188 can move on the rail pairs 186 to move BOPs, swarf units, and other equipment to the rail pairs 182 of the moonpool 183. The carts 188 can be moved using hydraulic skidding systems 189, such as known in the art.

Figure 8:
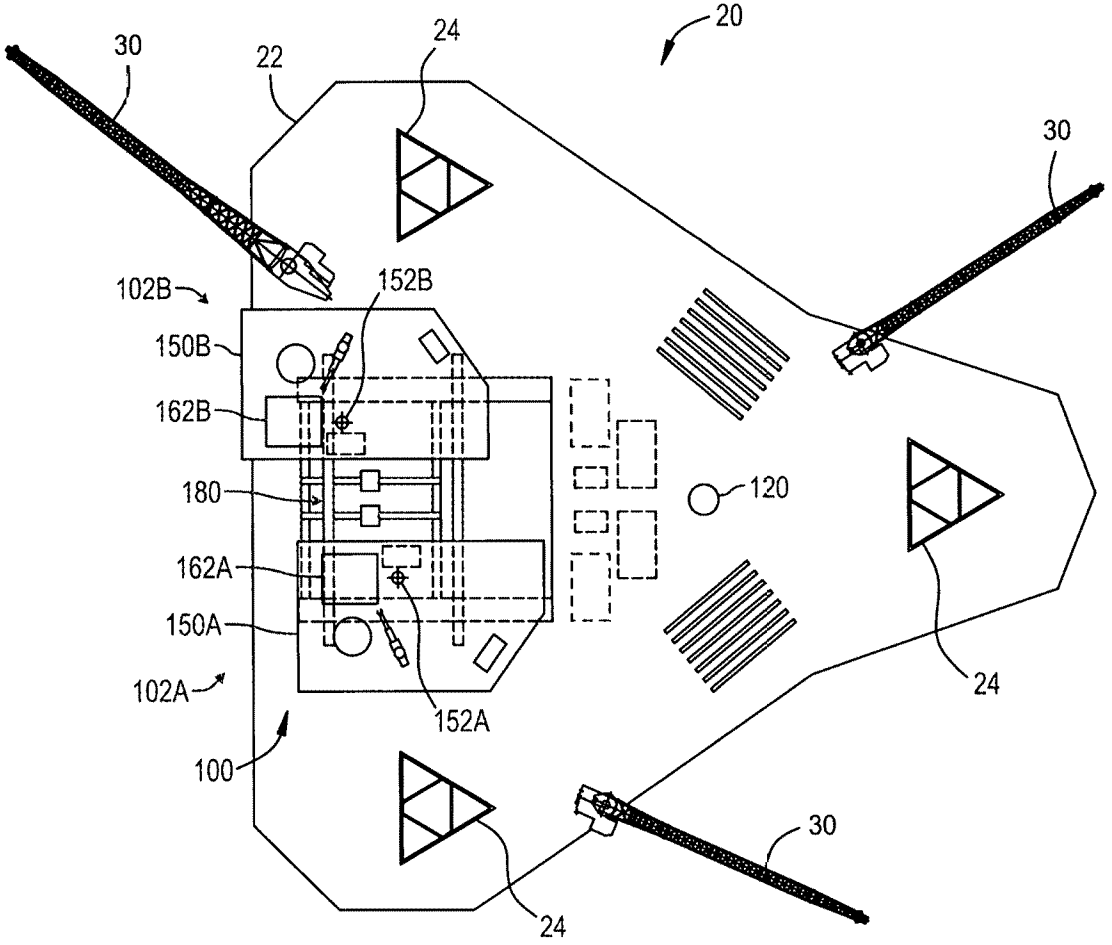
FIG. 8 illustrates a schematic plan view of another multiple tower rig according to the present disclosure.

In previous examples, the disclosed rig 20 includes a cantilever assembly 101 with cantilever base 110 movably coupled to the rig's hull 20. This is well suited for the rig 20 to be used in certain types of operations, such as decommissioning wells, working over wells, etc. Use of the cantilever assembly 101 with the base is not strictly necessary. For example, FIG. 8 illustrates a schematic plan view of another multiple tower rig 20 according to the present disclosure. Here, the rig 20 includes all of the same components as discussed above so like components may not be particularly pointed out here. As such, all previous details related to previous embodiments are incorporated here and apply equally well to this current rig 20.

In contrast to the previous examples, however, the multiple tower system 100 lacks a cantilever assembly with a base. Instead, the dual drill floor platforms 150A-B with their well centers 152A-B, towers 162A, and other components are movably disposed both laterally and longitudinally on a skidding system on the rig's hull 22 over a handling area 180 with moonpool and other comparable components. Again, although shown here as a jack-up rig, this rig 20 in FIG. 8 may be configured as a floating, fixed, or semi-submersible rig or vessel according to other embodiments.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An offshore rig for operating at separate wells, the rig comprising:

a hull positionable relative to the separate wells;

a cantilever assembly coupled to the hull and movably mounted in a plane relative to the hull; and at least two operational assemblies coupled to the cantilever assembly, each movably mounted independent of each other in the plane relative to the cantilever assembly and to the hull, the at least two operational assemblies being operable to conduct separate operations of the separate wells independent of one another in both time and space, wherein the cantilever assembly comprises an equipment handling assembly handling operational equipment for the at least two operational assemblies and being shared between the at least two operational assemblies moved independent of each other in the plane relative to the cantilever assembly and to the hull.

2. The rig of claim 1, wherein the separate operation is selected from the group consisting of decommissioning the separate well, plug and abandoning the separate well, working over the separate well, drilling the separate well, completing the separate well, and logging the separate.

3. The rig of claim 1, wherein the cantilever assembly comprises a base mounted on one or more beams of the hull, the base being moveable along at least one direction on the one or more beams relative to the hull.

4. The rig of claim 1, wherein the at least two operational assemblies each comprises a platform supported on the cantilever assembly and being moveable along at least one direction relative to the hull.

5. The rig of claim 4, wherein each of the platforms is mounted on one or more rails of the cantilever assembly, the platform moveable along the at least one direction on the one or more rails relative to the cantilever assembly.

6. The rig of claim 5, wherein each of the platforms is mounted on one or more pads disposed on the one or more rails of the cantilever assembly, each platform being moveable along another of the at least one direction on the one or more pads relative to the cantilever assembly.

7. The rig of claim 1, wherein the cantilever assembly is moveable at least along a first direction relative to the hull; and wherein the at least two operational assemblies are each independently moveable in the first direction and a second direction orthogonal to the first direction.

8. The rig of claim 1, wherein the at least two operational assemblies each comprises separate equipment dedicated to the operational assembly for conducting the separate operation.

9. The rig of claim 8, wherein the separate equipment is selected from the group consisting of fluid handling equipment, mud return equipment, well control equipment, solid handling equipment, pipe handling equipment, power generation equipment, and degasser equipment.

10. The rig of claim 1, wherein the at least two operational assemblies comprise equipment shared between the operational assemblies for conducting the separate operations.

11. The rig of claim 10, wherein the shared equipment is selected from the group consisting of BOP handling equipment, swarf skip equipment, a knuckle boom crane, and fluid handling equipment.

12. The rig of claim 1, wherein each of the at least two operational assemblies comprises a well center, the well centers of the at least two assemblies defining a work zone positionable relative to the separate wells.

13. The rig of claim 12, wherein the hull is positionable in a plurality of headings to position the defined work zone relative to the separate wells.

14. The rig of claim 1, wherein the cantilever assembly further comprises a fluid handling assembly handling fluid for the at least two operational assemblies and being shared between the at least two operational assemblies moved independent of each other in the plane relative to the cantilever assembly and to the hull.

15. An offshore rig for operating at separate wells, the rig comprising:

A hull positionable relative to the separate wells;

A cantilever assembly coupled to the hull and movably mounted relative to the hull, wherein the cantilever assembly comprises a handling area between at least two operational assemblies, the handling area comprising a plurality of rails movable in one direction on the cantilever assembly and comprising a plurality of carts movable on the rails in an orthogonal direction; wherein The least two operational assemblies are coupled to the cantilever assembly, each movably mounted independent of each other relative to the cantilever assembly and to the hull, the at least two operational assemblies being operable to conduct separate operations of the separate wells independent of one another in both time and space.

16. The rig of claim 15, wherein the handling area defines a moonpool positionable relative to the separate wells, wherein the plurality of rails comprises a first set of the rails movable in the one direction relative to the moonpool and comprises a second set of the rails movable in the one direction relative to the first set of the rails, whereby the first and second sets of rails are alignable and misalignable with one another.

17. The rig of claim 15, wherein each of the operational assemblies comprises a swarf unit having a pipe rotatably coupled thereto and communicating with the handling area between the at least two assemblies.

18. The rig of claim 15, wherein the cantilever assembly is movably mounted in a plane relative to the hull; and wherein the at least two operational assemblies are each movably mounted independent of each other in the plane relative to the cantilever assembly and to the hull.

19. The rig of claim 15, wherein each of the operational assemblies comprises a fluid return component being telescopic in a first direction with movement of the each operational assembly in the first direction relative to the cantilever assembly, and wherein the cantilever assembly comprises a trough in fluid communication with the fluid return component and allowing for translation of the first fluid return component in a second orthogonal direction with movement of the each operational assembly in the second direction relative to the cantilever assembly.

20. An offshore rig for operating at separate wells, the rig comprising:

a hull positionable relative to the separate wells;

a cantilever assembly coupled to the hull and movably mounted relative to the hull; and at least two operational assemblies coupled to the cantilever assembly, each movably mounted independent of each other relative to the cantilever assembly and to the hull, the at least two operational assemblies being operable to conduct separate operations of the separate wells independent of one another in both time and space, wherein each of the operational assemblies comprises a fluid return component being telescopic in a first direction with movement of the each operational assembly in the first direction relative to the cantilever assembly, and wherein the cantilever assembly comprises a trough in fluid communication with the fluid return component and allowing for translation of the first fluid return component in a second orthogonal direction with movement of the each operational assembly in the second direction relative to the cantilever assembly.

21. The rig of claim 20, wherein the cantilever assembly comprises separate fluid return equipment in fluid communication with each of the troughs for the at least two operational assemblies.

22. The rig of claim 20, wherein the cantilever assembly is movably mounted in a plane relative to the hull; and wherein the at least two operational assemblies are each movably mounted independent of each other in the plane relative to the cantilever assembly and to the hull.

23. The rig of claim 20, wherein the cantilever assembly comprises a handling area between the at least two operational assemblies, the handling area comprising a plurality of rails movable in one direction on the cantilever assembly and comprising a plurality of carts movable on the rails in an orthogonal direction.

24. An offshore rig for decommissioning of separate wells, the rig comprising:

a hull positionable relative to the separate wells;

a cantilever assembly coupled to the hull and movably mounted in a plane relative to the hull; and at least two decommissioning assemblies coupled to the cantilever assembly, each movably mounted in the plane independent relative to each other and relative to the cantilever assembly, the at least two decommissioning assemblies being configurable to conduct independent and simultaneous decommissioning operations of the separate wells, wherein the cantilever assembly comprises an equipment handling assembly handling decommissioning equipment for the at least two decommissioning assemblies and being shared between the at least two decommissioning assemblies moved independent of each other in the plane relative to the cantilever assembly and to the hull.

25. An offshore rig for operating at separate wells, the rig comprising:

a hull positionable relative to the separate wells;

a cantilever assembly coupled to the hull and movably mounted in a plane relative to the hull; and at least two operational assemblies coupled to the cantilever assembly, each movably mounted independent of each other in the plane relative to the cantilever assembly and to the hull, the at least two operational assemblies being operable to conduct separate operations of the separate wells independent of one another in both time and space, wherein the cantilever assembly comprises a fluid handling assembly handling fluid for the at least two operational assemblies and being shared between the at least two operational assemblies moved independent of each other in the plane relative to the cantilever assembly and to the hull.

26. The rig of claim 25, wherein the separate operation is selected from the group consisting of decommissioning the separate well, plug and abandoning the separate well, working over the separate well, drilling the separate well, completing the separate well, and logging the separate.

27. The rig of claim 25, wherein the cantilever assembly comprises a base mounted on one or more beams of the hull, the base being moveable along at least one direction on the one or more beams relative to the hull.

28. The rig of claim 25, wherein the at least two operational assemblies each comprises a platform supported on the cantilever assembly and being moveable along at least one direction relative to the hull.

29. The rig of claim 28, wherein each of the platforms is mounted on one or more rails of the cantilever assembly, the platform moveable along the at least one direction on the one or more rails relative to the cantilever assembly.

30. The rig of claim 29, wherein each of the platforms is mounted on one or more pads disposed on the one or more rails of the cantilever assembly, each platform being moveable along another of the at least one direction on the one or more pads relative to the cantilever assembly.

31. The rig of claim 25, wherein the cantilever assembly is moveable at least along a first direction relative to the hull; and wherein the at least two operational assemblies are each independently moveable in the first direction and a second direction orthogonal to the first direction.

32. The rig of claim 25, wherein the at least two operational assemblies each comprise separate equipment dedicated to the operational assembly for conducting the separate operation.

33. The rig of claim 32, wherein the separate equipment is selected from the group consisting of fluid handling equipment, mud return equipment, well control equipment, solid handling equipment, pipe handling equipment, power generation equipment, and degasser equipment.

34. The rig of claim 25, wherein the at least two operational assemblies comprises equipment shared between the operational assemblies for conducting the separate operations.

35. The rig of claim 34, wherein the shared equipment is selected from the group consisting of BOP handling equipment, swarf skip equipment, a knuckle boom crane, and fluid handling equipment.

36. The rig of claim 25, wherein each of the at least two operational assemblies comprises a well center, the well centers of the at least two assemblies defining a work zone positionable relative to the separate wells.

37. The rig of claim 36, wherein the hull is positionable in a plurality of headings to position the defined work zone relative to the separate wells.

38. An offshore rig for decommissioning of separate wells, the rig comprising:

a hull positionable relative to the separate wells;

a cantilever assembly coupled to the hull and movably mounted in a plane relative to the hull; and at least two decommissioning assemblies coupled to the cantilever assembly, each movably mounted in the plane independent relative to each other and relative to the cantilever assembly, the at least two decommissioning assemblies being configurable to conduct independent and simultaneous decommissioning operations of the separate wells, wherein the cantilever assembly comprises a fluid handling assembly handling fluid for the at least two decommissioning assemblies and being shared between the at least two decommissioning assemblies moved independent of each other in the plane relative to the cantilever assembly and to the hull.

* * * * *